US007370438B2

(12) United States Patent
Vattes et al.

(10) Patent No.: US 7,370,438 B2
(45) Date of Patent: May 13, 2008

(54) REMOVABLE OR REVERSIBLE LINING FOR FOOTWEAR

(75) Inventors: David Vattes, Londonderry, NH (US); Peter Dillon, Topsfield, MA (US)

(73) Assignee: The Timberland Company, Stratham, NH (US)

( * ) Notice: Subject to any disclaimer, the term of this patent is extended or adjusted under 35 U.S.C. 154(b) by 408 days.

(21) Appl. No.: 11/000,875

(22) Filed: Dec. 1, 2004

(65) Prior Publication Data

US 2006/0112595 A1 Jun. 1, 2006

(51) Int. Cl.
*A43B 17/00* (2006.01)
*A43B 3/24* (2006.01)

(52) U.S. Cl. ..... 36/10; 36/100

(58) Field of Classification Search ..... 36/10, 36/55, 100, 101, 43, 44
See application file for complete search history.

(56) References Cited

U.S. PATENT DOCUMENTS

| | | | | | |
|---|---|---|---|---|---|
| 384,155 | A | * | 6/1888 | Hathorn | 36/1 |
| 1,189,989 | A | * | 7/1916 | Moore | 36/1 |
| 3,925,916 | A | | 12/1975 | Garbuio | |
| 4,302,889 | A | | 12/1981 | Negrin | |
| 4,309,832 | A | * | 1/1982 | Hunt | 36/32 R |
| 4,316,333 | A | * | 2/1982 | Rothschild | 36/50.1 |
| 4,538,368 | A | | 9/1985 | Mugford | |
| 4,599,810 | A | | 7/1986 | Sacre | |
| 4,930,175 | A | | 6/1990 | Chen | |
| 5,499,459 | A | | 3/1996 | Tomaro | |
| 5,526,584 | A | | 6/1996 | Bleimhofer et al. | |
| 5,778,473 | A | | 7/1998 | Chen | |
| 5,802,740 | A | | 9/1998 | Merk, Sr. | |
| 5,855,079 | A | | 1/1999 | Herbert et al. | |
| 5,933,987 | A | * | 8/1999 | Demarchi | 36/115 |
| 5,937,543 | A | | 8/1999 | Hall et al. | |
| 6,065,227 | A | | 5/2000 | Chen | |
| 6,151,802 | A | | 11/2000 | Reynolds | |
| 6,367,166 | B1 | | 4/2002 | Barthelemy et al. | |
| 6,474,002 | B2 | | 11/2002 | Chen | |
| 2003/0093919 | A1 | | 5/2003 | Wang | |
| 2004/0244221 | A1 | * | 12/2004 | Hall et al. | 36/10 |
| 2005/0011083 | A1 | * | 1/2005 | Kosted | 36/9 R |

* cited by examiner

*Primary Examiner*—Ted Kavanaugh
(74) *Attorney, Agent, or Firm*—Lerner, David, Littenberg, Krumholz & Mentlik, LLP

(57) ABSTRACT

The present invention relates to removable and/or replaceable liners for use in a wide variety of footwear. Liners may be permanently connected to the collar of the shoe, or may be semi-permanently attached for easy removal from the collar. The liners can be quickly removed from the interior of the shoe using any number of disengagement devices. Removing the liner from within the shoe permits rapid drying of the liner when it becomes wet due to moisture generated by the foot within the shoe or from external environmental conditions. Semi-permanently attached liners can be detached for cleaning or for replacement by another liner depending on the needs of the wearer. Disengagement means can be provided in conjunction with the liner, which enable the wearer to easily pull the liner out of the shoe.

29 Claims, 11 Drawing Sheets

REMOVABLE OR REVERSIBLE LINING FOR FOOTWEAR

BACKGROUND OF THE INVENTION

The present invention relates generally to a lining material for use in the interior of footwear. More particularly, the present invention relates to an inner liner that is reversible and/or removable.

Footwear typically includes an external portion and an internal portion. The external portion comprises functional and aesthetic materials designed, in part, to protect the wearer's foot against the elements, in addition to making the shoe aesthetically appealing. Leathers and synthetics are examples of rugged materials that are used on the external surface of a shoe. The internal surface or lining of a shoe is typically designed to promote the comfort of the wearer's foot. In addition to a soft, comfortable footbed that the foot rests on, the shoe lining is typically soft and smooth to protect against abrasion of skin.

During wear, mechanical stress occurs between the foot and the shoe. However, other stresses arise within the shoe that may create discomfort for the wearer. Among the most noticeable are environmental stresses created by the external or ambient climate (e.g., rain, snow, heat) and the internal or micro climate created by the foot while it is in the shoe. Because the foot is typically confined in a shoe, heat and moisture (in the form of perspiration) produced by the foot build up inside the shoe and are difficult to control. During intense activities the lining of a shoe can become saturated with perspiration. In addition, weather conditions such as snow and rain can cause the lining of a shoe to become saturated with water.

The condition of a lining within a shoe is extremely important, as the lining is a component that has very close proximity to the foot and has a direct impact on the comfort of the foot. Attempts have been made to control the internal environment of a shoe through climate control features such as waterproof-permeable membranes and airflow systems. These features have had only limited success, primarily because they are overpowered by the internal micro climate of the shoe and the external macro climate of the elements. For example, once the interior of the shoe becomes saturated with moisture, it is difficult to dry out the shoe. One could try to air dry the shoe, which is time consuming. Alternatively, one could use heating devices such as a hair dryer. However, in this case, the inside of the shoe can become very hot, which could damage components of the shoe. Furthermore, using a hair dryer or other heating device with the lining in situ rarely results in thorough drying inside the shoe. Thus, there remains a need for a lining that is quickly and easily refreshable and/or replaceable in order to provide an immediate, renewed environment to the internal cavity of the shoe.

SUMMARY OF THE INVENTION

The present invention addresses the deficiencies discussed above, and provides various types of reversible and/or removable liners that can be used with many different kinds of footwear.

In order to overcome deficiencies in conventional footwear, it is desirable to provide a shoe with a liner that is refreshable and/or replaceable. In preferred embodiments, the liner is attached to the shoe only at the top portion or collar of the shoe. The collar defines a top opening into the shoe. In many shoes, the collar comprises portions of the medial and lateral sides, as well as a portion of the back of the upper. In other shoe designs, the collar also includes a tongue, which typically forms the front of the collar. The collar desirably includes not only the top edge of the upper, but also a region that extends below the top edge, as will be explained below. The attachment between the liner and the collar can be permanent as in the case of a stitched-in or otherwise permanently secured lining, or replaceable by making the attachment from a semi-permanent attachment like a hook and loop fastener, zipper, or snap closure. In either case, the lining can be removed from the internal cavity of the shoe and dried via passive (air dry) or assisted mechanisms (hot air dryers such as hair dryers).

In a permanently stitched-in liner, one can reach into the shoe and pull the liner out of the shoe until it reaches its stitching limitations. Since the liner is attached at the collar of the shoe, one can essentially remove all of the lining from the shoe. In other words, although the liner is attached to the collar, it is also substantially, if not completely removed from the interior of the shoe. Removing the liner in this manner subjects it to greater convective airflow as compared to a typical liner that remains inside the shoe's internal cavity, and therefore increases the drying rate of the liner. It has been discovered that a liner removed from the internal shoe cavity will dry faster, as much as 300% faster, than a liner that remains in the shoe's internal cavity.

With a replaceable or detachable liner, the entire liner can be completely separated from the shoe. The liner could then be air dried, or washed by any number of methods such as hand washing or using a washing machine. Drying can likewise be done using any number of methods such as clothes dryers, hair dryers, microwaves, heating elements or the like.

Replaceable liners can have greater functionality then simply changing to a dry lining. Once an article of footwear is fitted with a replaceable liner, the wearer could switch liners based on need. Waterproof liners, moisture wicking liners, liners providing additional warmth, comfort liners, and air permeable liners could all be switched in and out of a shoe depending on the weather conditions and activities of the wearer. For instance, in cold climates, a wearer might use a liner with extra insulation qualities. Wet climates might call for waterproof liners. Arid climates might call for liners with high permeability ratings.

A replaceable liner can be attached to the shoe through the use of a reusable closure system such as hook and loop fasteners, zippers, or a snap closer system. Any closure system that enables the user to repeatedly detach and reattach the liner is appropriate for use.

To assist in the disengagement of the liner, pull-tabs, handle elements or other grip structures/devices may be placed, for example, on the bottom of the liner at the heel, forefoot, or both positions. Such grip devices are preferably disposed on the inner surface of the liner. This allows the wearer to quickly find a handhold or grab point from which to pull on the liner. Of course, the pull-tab or other grip device may be placed anywhere along the liner where it is convenient. Placement in different locations can facilitate disengagement of the liner from the shoe interior, exposure of the liner to ambient air or other drying options, and/or re-engagement of the liner into the interior cavity. Optionally, multiple grip devices or gripping points can be placed on the inner surface of the liner. However, placing the pull-tab or other device on or adjacent to the bottom of the liner allows for the tabs to be hidden by the shoe's footbed. This provides comfortable placement for the pull-tab since the overlaying footbed will keep the pull-tab from coming into contact with the wearer's foot, and will prevent the wearer from noticing the pull-tab or other device. Although not limited to being placed under the footbed, this location prevents the pull-tab from rubbing on the wearer's foot and creating discomfort.

In accordance with an embodiment of the present invention, an article of footwear is provided. The article of footwear comprises an outsole, an upper and a liner. The upper is attached to the outsole and has an interior surface including a collar and a body connected to the collar. The body defines a cavity for receiving a foot and the collar providing an opening to the cavity. The liner is configured to at least partly encompass the foot within the cavity. The liner includes a connector to securely connect the liner about the collar and a disengagement unit to aid a user in removing the liner from within the cavity.

In one example the disengagement unit may comprise a pull-tab. In this case, the pull-tab is preferably affixed to a bottom portion of the liner. The pull-tab may comprise nylon, and may also include a plurality of connection points to connect to the bottom portion of the liner.

In another example the disengagement unit comprises a loop of material affixed to a bottom portion of the liner. In a further example the disengagement unit comprises hook and loop fasteners. In yet another example the disengagement unit comprises a handle. In another example the disengagement unit comprises fabric flap. In a further example the disengagement unit comprises a slit in a bottom portion of the liner.

In an alternative, the article of footwear may further comprise a removable footbed having a top surface adapted to contact the foot and a bottom surface for overlying an inner surface of the liner when the removable footbed is disposed within the cavity. In this case, the bottom surface of the footbed desirably at least partly covers the disengagement unit.

In another alternative, a bottom portion of the liner preferably comprises a rigid or semi-rigid structure. In this case, the bottom portion of the liner may include a living hinge. Preferably, the rigid or semi-rigid structure is cotton drill, cardboard, an injected plastic or a plastic film. In a further alternative, the connector permanently secures the liner to the collar. In yet another alternative, the connector semi-permanently secures the liner to the collar. In another alternative, the upper includes a tongue and the connector securely connects the liner to the tongue.

In accordance with another embodiment of the present invention, an article of footwear is provided. The article of footwear comprises an outsole, an upper and a liner. The upper attaches to the outsole and has an interior surface including a collar and a body connected to the collar. The body defines a cavity for receiving a foot and the collar provides an opening to the cavity. The liner is configured to at least partly encompass the foot within the cavity. The liner includes a connector to removably connect the liner about the collar so that a user can completely remove the liner from the article of footwear.

In one example the connector comprises a hook and loop fastener. In another example the connector comprises a zipper. In a further example the connector comprises at least one snap fastener. In yet another example the connector comprises at least one hook fastener. In a further example the connector comprises at least one button.

The liner may be interchangeable with a plurality of different liners. In this case, at least one of the plurality of different liners preferably comprises a hydrophobic liner, a hydrophilic liner, a high permeability liner, a comfort liner or a fleece liner.

In accordance with a further embodiment of the present invention, a kit of footwear liners for use with an article of footwear is provided. The kit comprises interchangeable liners configured to at least partly encompass a foot within a cavity of the article of footwear. Each of the interchangeable liners includes a connector to removably connect the liner about a collar of the article of footwear so that a user can completely detach the liner from the article of footwear. The interchangeable liners can be selected depending on climate conditions or a type of activity. Preferably, the interchangeable liners are selected from the group consisting of a hydrophobic liner, a hydrophilic liner, a high permeability liner, a comfort liner and a fleece liner.

In accordance with yet another embodiment of the present invention, a method of removing a liner from within an article of footwear is provided. The liner has a disengagement unit attached thereto or integral therewith. The method comprises gripping the disengagement unit of the liner; pulling the disengagement unit, and lifting the liner until the liner is substantially completely removed from within an interior cavity of the article of footwear.

In one alternative, the method further comprises removing a footbed from the article of footwear prior to gripping the disengagement unit. In another alternative, the method further comprises detaching the liner from a collar of the article of footwear, and completely removing the liner from the article of footwear. In a further alternative, the disengagement unit comprises a pull-tab and gripping the disengagement unit includes at least partly encircling the pull-tab with a user's hand.

In accordance with a further embodiment of the present invention, a footwear liner for use with an article of footwear is provided. The footwear liner is configured to at least partly encompass a foot within a cavity of the article of footwear. The liner has an inner surface facing the foot during wear, and the inner surface includes a disengagement unit to aid a user in removing the liner from within the cavity. The footwear liner preferably further comprises a connector to securely connect the liner about an interior surface of a collar of the article of footwear.

In accordance with another embodiment of the present invention, an article of footwear is provided. The article of footwear comprises an outsole, an upper, and a liner. The upper is attached to the outsole, and has an interior surface including a collar and a body connected to the collar. The body defines a cavity for receiving a foot and the collar provides an opening to the cavity. The liner is configured to at least partly encompass the foot within the cavity. The liner includes a device to aid a user in removing the liner from within the cavity, whereby the user can take hold of the device and extract the liner from the cavity.

In one example the device includes multiple gripping segments. In another example the device is disposed at a bottom portion of the liner. In this case, the device is preferably connected at multiple locations on an inner surface of the bottom portion of the liner. In a further example the device is disposed at the sidewall of the liner.

In yet another example the device includes multiple devices. A first one of the devices is disposed on the bottom portion of the liner. A second one of the devices is disposed on the sidewall of the liner or on a connection portion of the liner about a topmost portion of the collar.

In accordance with a further embodiment of the present invention, an article of footwear is provided. The article of footwear comprises an outsole, an upper attached to the outsole, and a liner. The upper has an interior surface including a collar and a body connected to the collar. The body defines a cavity for receiving a foot and the collar provides an opening to the cavity. The liner is configured to at least partly encompass the foot within the cavity. The liner including a connector to securely connect the liner to the collar and a disengagement unit to aid a user in removing the liner from within the cavity. The disengagement unit including a strip of material secured at multiple locations to an inner surface of a bottom portion of the liner. The multiple locations include a first location at a toe region of the bottom portion and a second location at a heel region of the bottom portion.

In an alternative, the article of footwear further comprising a removable footbed having a top surface adapted to contact the foot and a bottom for overlying the bottom portion of the liner when the removable footbed is disposed within the cavity. The bottom of the removable footbed includes a recess adapted to receive the disengagement unit so that the disengagement unit is disposed within the recess during wear and is not felt by the user during wear. In another alternative, the strip of material of the disengagement unit is secured at multiple locations along a central line to the inner surface of the bottom portion of the liner. In yet another alternative, the liner at least partly contacts the body of the interior surface.

DETAILED DESCRIPTION

In describing the preferred embodiments of the invention illustrated in the appended drawings, specific terminology will be used for the sake of clarity. However, the invention is not intended to be limited to the specific terms used, and it is to be understood that each specific term includes all technical equivalents that operate in a similar manner to accomplish a similar purpose.

Figure 1:
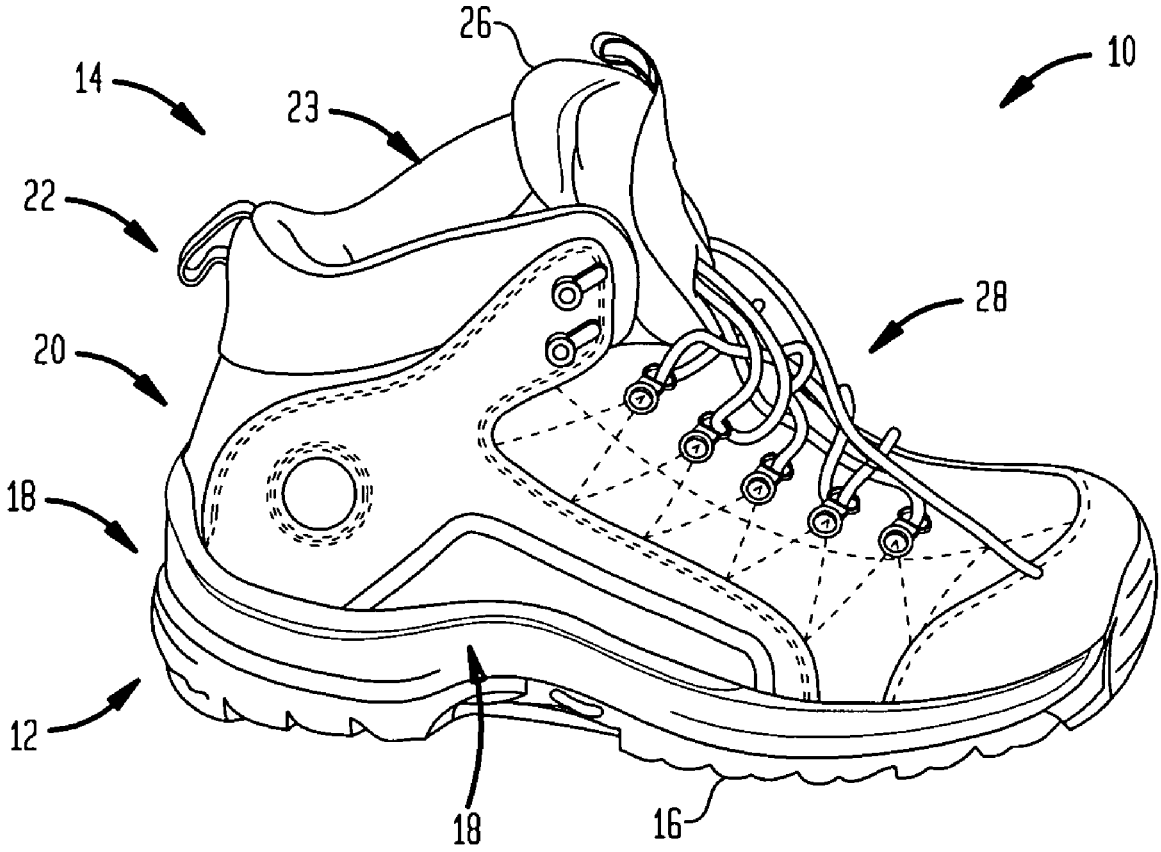
FIG. 1 illustrates a side view of a shoe in accordance with aspects of the present invention.

FIG. 1 illustrates an exemplary shoe 10 suitable for use with liners in accordance with the present invention. The shoe 10 may be any type of conventional footwear type, including, but not limited to dress shoes, loafers, athletic shoes such as sneakers, work boots, hiking boots, etc. Here, the exemplary shoe is shown having an outsole 12 and an upper 14. The outsole 12 may include a tread 16 on the bottom thereof. As shown, a region 18 connects the outsole 12 to the upper 14. The region 18 may be integral with the outsole 12, or may comprise a separate midsole, a lasting board, etc. Alternatively, the outsole 12 and the upper 14 may be integrally formed as a single piece. Additional features such as a shank piece, arch support, etc. (not shown), may be fixed as part of the shoe 10 or may be removable therefrom.

Figure 2:
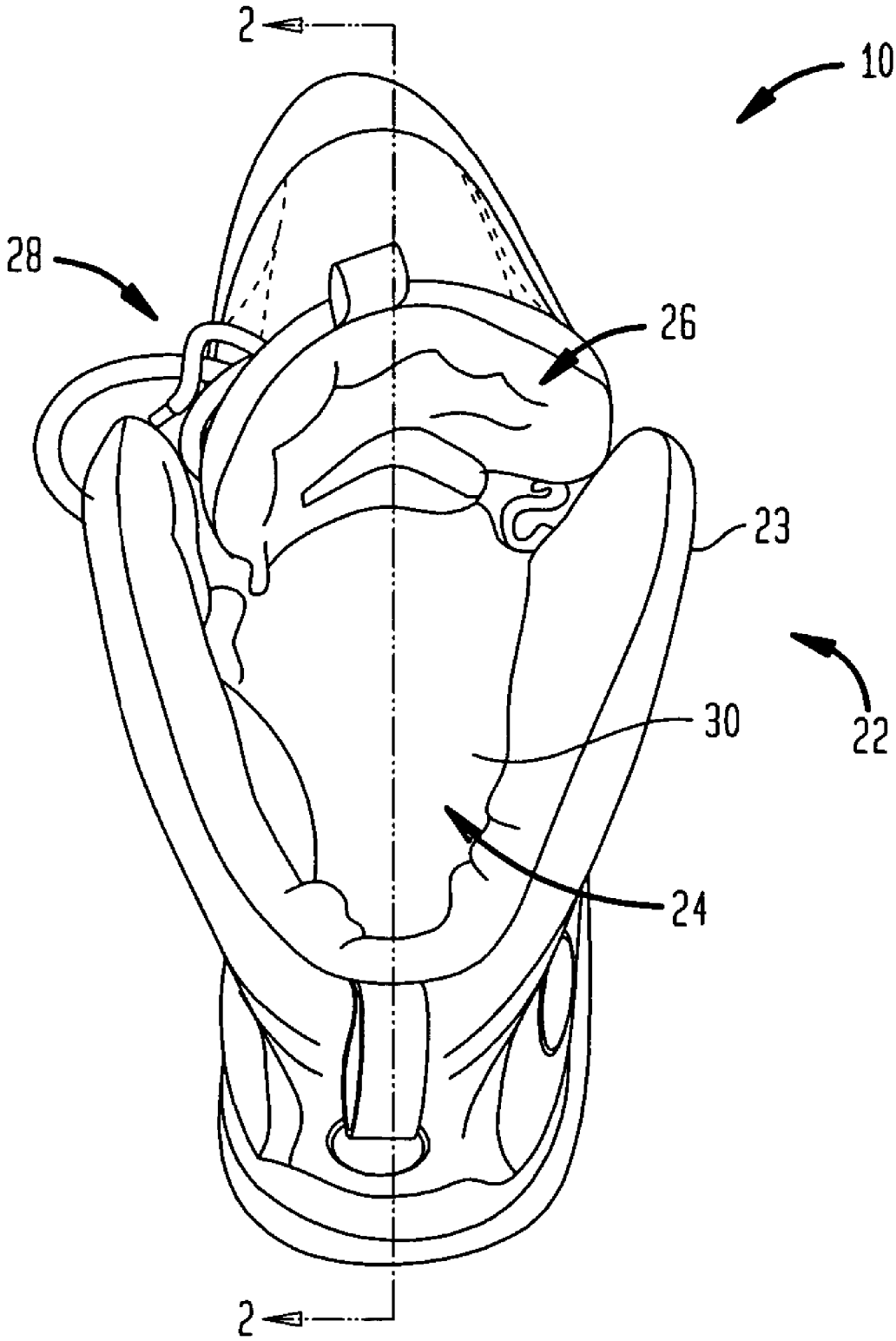
FIG. 2 illustrates a top down view of the shoe of FIG. 1.

The upper 14 may include a body 20 as well as a collar region. As seen in FIG. 2, the collar region or "icollar" 22 defines an opening that enables a wearer to insert his or her foot into an interior cavity 24 of the body 20. The collar 22 preferably includes not only a topmost potion (e.g., a top edge or a top line) 23 of the upper 14, but may also extend inches below the top edge or top line 23 of the upper 14. Depending on the height of the footwear about the wearer's ankle, the collar 22 may extend many inches below the top line 23. For example, the collar 22 may be higher or lower if the shoe extends above the ankle. The higher the shoe is above the ankle, the higher the collar region 22, perhaps as much as six to eight inches or more for very high boots. Alternatively, in a midsize boot, the collar 22 may include a region that extends from the top edge of the upper at least two to four inches down to the ankle of the wearer. In contrast, in a low-riding shoe, for example where the opening is near or below the ankle, the collar 22 may include a very small region on the order of k inch or less that includes the topmost portion of the upper. In accordance with aspects of the present invention, it is preferable for the collar 22 to be above the instep in most shoe structures. The collar 22 may have a tongue 26, which the wearer can pull to simplify putting on the shoe 10. The body 20 may include laces 28 or other fasteners such as hook and loop fastening straps, snaps, clips, etc. to secure the foot in the shoe 10.

The shoe 10 may also include a footbed 30 that is configured to receive the wearer's foot within the interior cavity 24. Any type of footbed 30 may be used in accordance with the present invention, including custom orthotics, sockliners, etc. The footbed 30 may be formed from resilient materials such as ethyl vinyl acetate ("EVA") and polyurethane ("PU") foams or other such materials commonly used in shoe midsoles, insoles or sockliners. The footbed 30 may be fabricated using multiple material layers, regions and/or segments, which may each have a different thickness and/or a different rigidity. For example, the footbed 30 may comprise multiple layers of different rigidity. Alternatively, the footbed 30 may have different levels of rigidity in the forefoot, instep and heel regions, respectively. The footbed 30 could also have a first segment about the first metatarsal of a first rigidity and a second segment about the fifth metatarsal of a second rigidity.

Figure 3A:
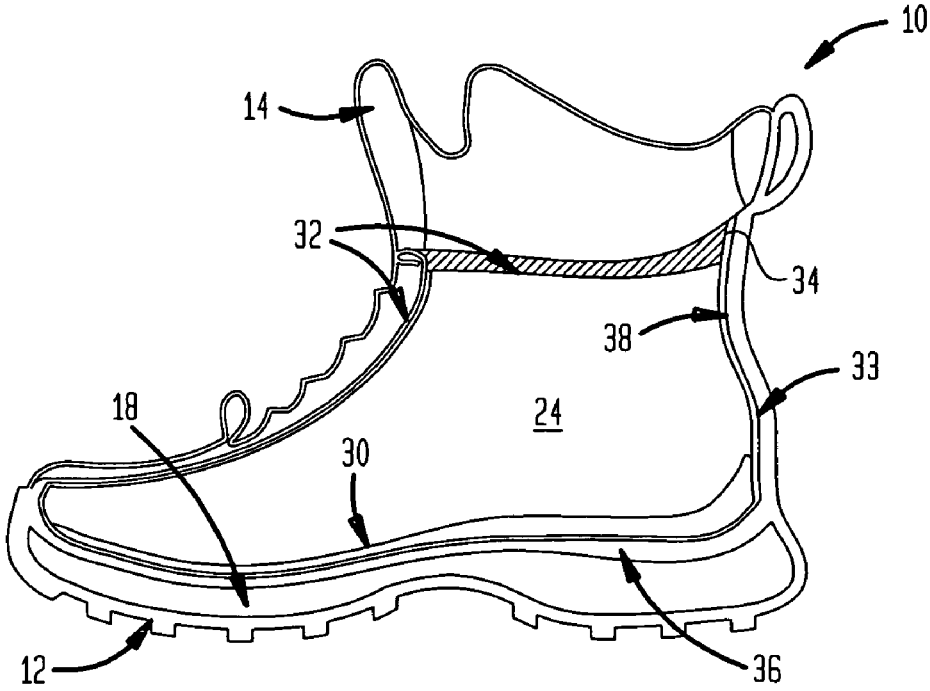
FIGS. 3(*a*)-(*b*) illustrate features of the shoe of FIG. 1.
Figure 3B:
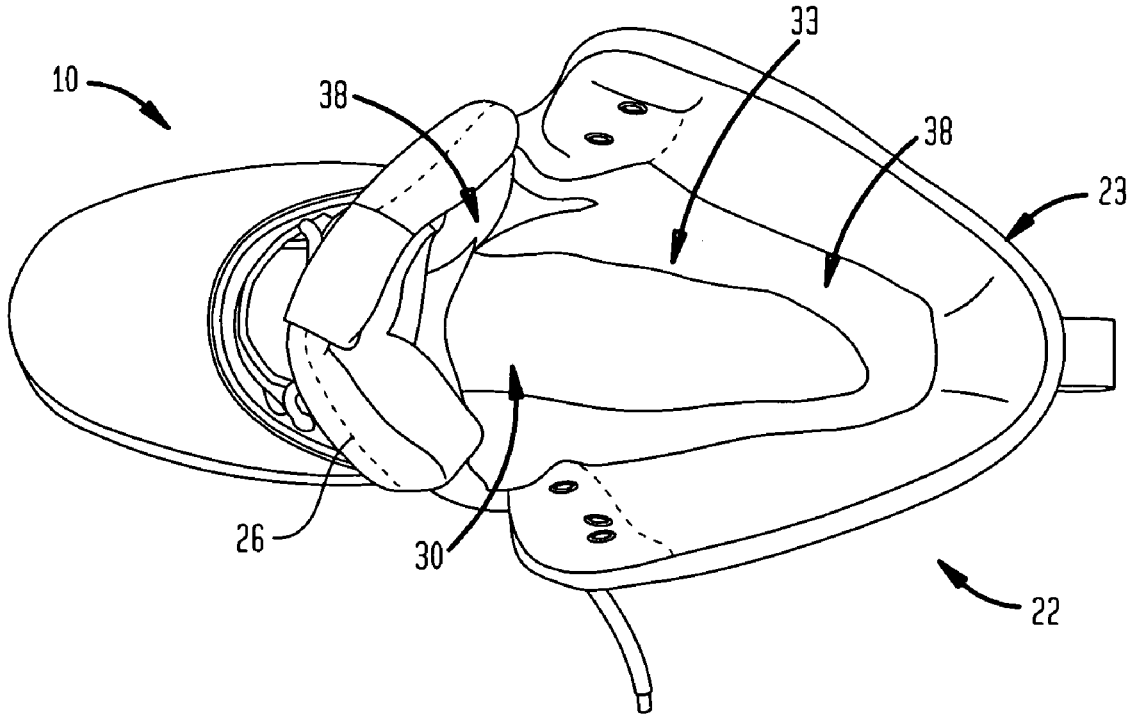

FIG. 3(*a*) illustrates a side cutaway view of the shoe 10 along the 2-2 line of FIG. 2. As seen in FIG. 3(*a*), the region 18 may comprise a midsole that connects the outsole 12 to the upper 14. Within the interior cavity 24 is a liner 32 that preferably substantially conforms in shape to the sides and floor or bottom of the interior cavity 24. The liner 32 has a first or outer surface that faces the interior cavity 24, as well as a second or inner surface that faces the foot.

The liner 32 may comprise one or more sections or layers of material that are sewn or otherwise attached together. Any number of materials or combinations of materials may be used as part of the liner 32. By way of example only, suitable materials include cotton, polyester, nylon, silk and wool. A thin foam layer, such as 2 mm of low density, open cell foam, may also be used as a backing to provide enhanced padding. Additional materials may include a stretchable or elastically resilient material such as spandex textile filament fiber or elastane, for example the LYCRA brand manufactured by E.I. DuPont De Nemours and Company. The materials may be fabricated, for example, as knits, wovens, non-wovens or microfibers. Preferably, the liner 32 includes a nylon knit textile commonly referred to as "JC mesh," a brushed nylon commonly referred to as "nylex," or a polyester fiber knit textile commonly referred to as "fleece."

The material(s) of the liner 32 may be selected depending upon the type of shoe, intended use, climate conditions, etc. For instance, wet climates may call for a waterproof (hydrophobic) liner such as the GORE-TEX brand manufactured by W. L. Gore & Associates, Inc., or the EVENT brand manufactured by BHA Technologies, Inc. A liner with a high permeability rating could be used in arid climates. Cold climates may be particularly suitable for a warmer fleece-type liner. A comfort liner, such as a liner having foam padding, or a moisture wicking (hydrophilic) liner may be preferred for exertive activities like running or hiking.

The liner 32 desirably includes at least one sidewall 33, a connection portion 34, and a bottom portion 36. The sidewall 33, the connection portion 34, and the bottom 36 may be of the same or different materials. The sidewall 33 preferably conforms to the shape of the interior walls of the body 20 of the upper 14. Alternatively, the sidewall 33 may be configured to conform to the shape of the wearer's foot. By way of example only, a single sidewall may wrap around the foot, or a pair of medial and lateral sidewalls may be formed on either side of the foot and stitched or otherwise connected to one another.

The connection portion 34 preferably includes a connector 38 for affixing the liner 32 to the collar 22. The connector 38 may provide a permanent or semi-permanent attachment to the collar 22. For permanent attachment, the liner 32 may be sewn, glued or otherwise bonded to the collar 22. In this case, the connector 38 would include the stitching, glue or other bonding element. Alternatively, the liner 32 may be integrally formed as part of the upper 14. For semi-permanent attachment, any number of releasable connectors 38 may be employed. Referring to FIGS. 9(*a*)-(*e*), respectively, semi-permanent fastening may be achieved using, for example, strips of hook and loop fasteners, one or more buttons, a zipper, one or more snap fasteners and/or one or more hook/clip fasteners (referred to collectively as "fasteners"). Alternatively, lacing or any other releasable connectors 38 could also be used. In use, one part of the fastener may be placed on the connection portion 34 and the reciprocal or mating part of the fastener may be placed on the collar 22. Depending upon the connector 38 and its placement, the fastener need not be visible when the person is wearing the shoe.

The connection portion 34 may attach at any location on the collar 22. The position(s) where the connection portion 34 attaches to the collar 22 can be based on selection criteria that include the style and configuration of the footwear, as well as the type of connector(s) 38 employed. In the most preferable embodiment, the positioning of the connection portion 34 relative to the collar 22 is a function of the height of the footwear above the ankle. Thus, depending on the height of the footwear, preference is for the connector 34 to be located above the ankle in footwear such as boots that extend above the ankle and below the ankle for low riding shoes such as men's dress shoes. The placement of the connection portion 34 and the connector 38 on the collar 22 can also be based on comfort preferences for particular footwear design, facilitating grasping the shoe for the purposes of placing the footwear on the shoe of the wearer and/or maximizing the function of the liner 32 as discussed herein, for example, to provide warmth, water resistance or wicking. Thus, in an embodiment of a performance boot, such as a work boot or hiking boot, the connector 38 may be affixed to the collar at a point below the top line and above the ankle. The point of attachment in this case can vary as discussed herein with preference in such performance footwear being in the range of one to three inches below the top line and most preferably on the order of two inches below the top line. Similar proportional ranges depend on the actual height of a particular article of footwear in which the liner 32 is included and in which the connector(s) 38 is adapted to engage the collar 22. In a low riding shoe, the range in which the liner 32 is connected to the collar 22 by the connector 38 is preferably smaller, for example, anywhere from ½ inch below the top line to approximately 2 inches below the top line.

Returning to FIG. 3(*a*), the inner surface of the bottom portion 36 of liner 32 is typically covered by the footbed 30 during wear. Alternatively, if the shoe 10 does not include a footbed, then the inner surface of the bottom portion 34 may directly contact the underside of the foot or the wearer's sock.

FIG. 3(*b*) illustrates a top-down view of the shoe 10 when ready for wear. As seen in the figure, the liner 32 preferably covers the interior sides of the upper 14, and the footbed 30 is disposed within the interior cavity 24 over the bottom portion 36 of the liner 32. As discussed above, the connector 38 attaches the liner 32 to the collar 22. The connector 38 can attach the liner 32 to the tongue 26 and/or to other portions of the collar 22, such as the medial side, lateral side and/or the back of the collar for a secure attachment. For some shoe constructions, it is desirable to attach the liner 32 to the tongue 26 to promote proper placement of the tongue, to facilitate effective drying, etc.

In accordance with an aspect of the present invention, the liner 32 can be easily and rapidly removed from the interior cavity 24. As discussed above, pulling the liner 32 out of the interior cavity 24 preferably using a handhold or grab point allows the liner 32 to be dried and/or cleaned. A semi-permanently attached liner 32 can be completely detached from the rest of the shoe 10, which permits the wearer to exchange the liner 32 for a different liner depending upon his or her needs, and/or to clean and dry the liner 32.

Figure 4A:
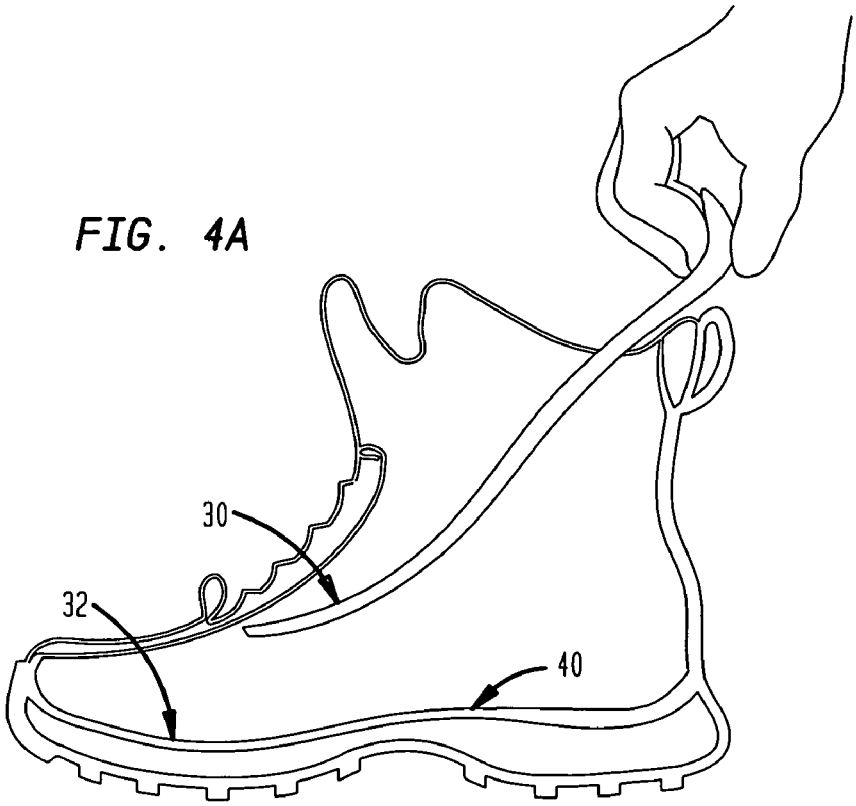
FIGS. 4(*a*)-(*b*) illustrate removing a footbed from the shoe in accordance with aspects of the present invention.
Figure 4B:
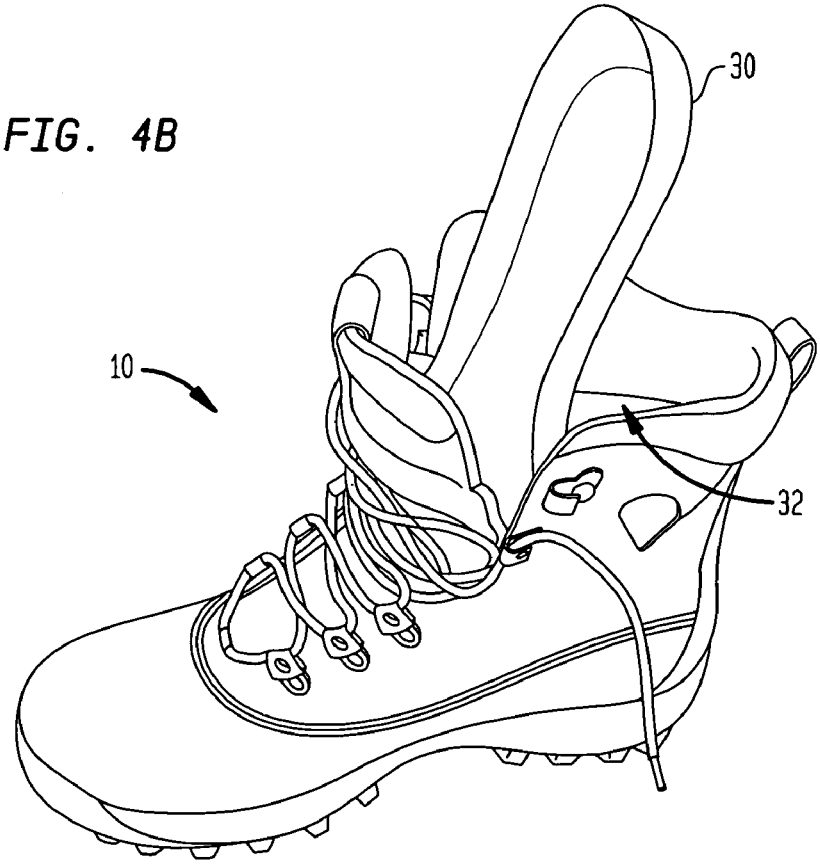

The process of removing the liner 32 from the shoe 10 will now be described. FIG. 4(*a*) illustrates a side cutaway view of the shoe 10 along the 2-2 line of FIG. 2. As seen in FIG. 4(*a*), if the shoe 10 includes the footbed 30 (or a custom orthotic and/or other insert), the footbed 30 is first removed from within the shoe 10. FIG. 4(*b*) illustrates a perspective view showing the footbed 30 partly removed from the shoe 10.

Figure 5A:
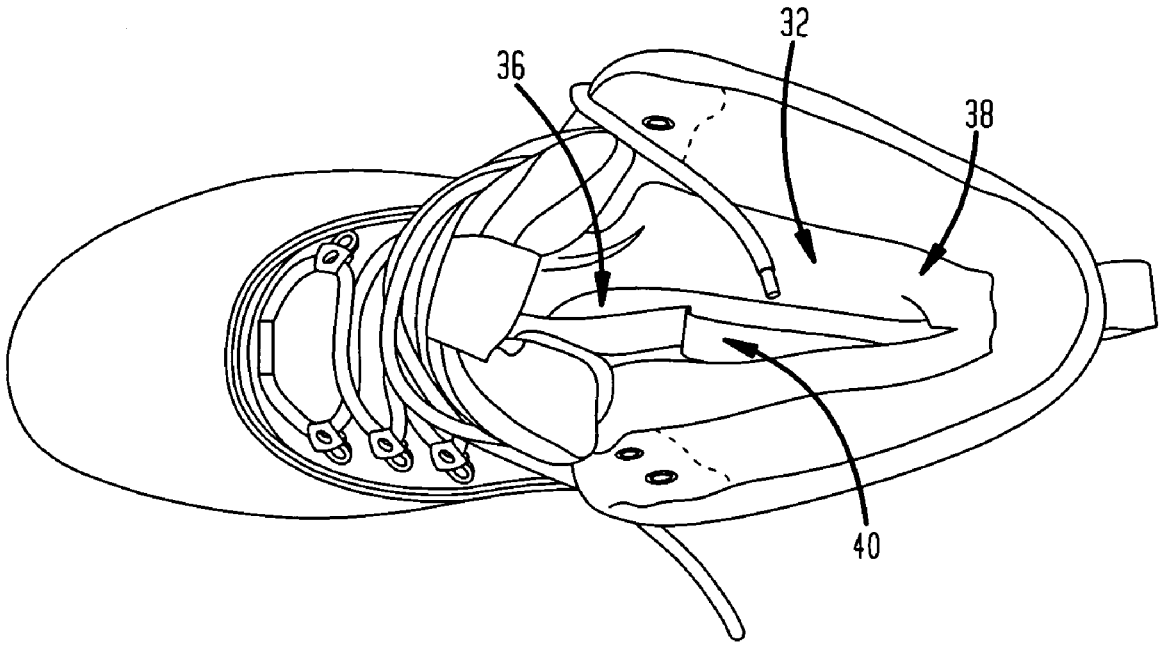
FIGS. 5(*a*)-(*c*) illustrate removal of a liner from the shoe in accordance with aspects of the present invention.
Figure 5B:
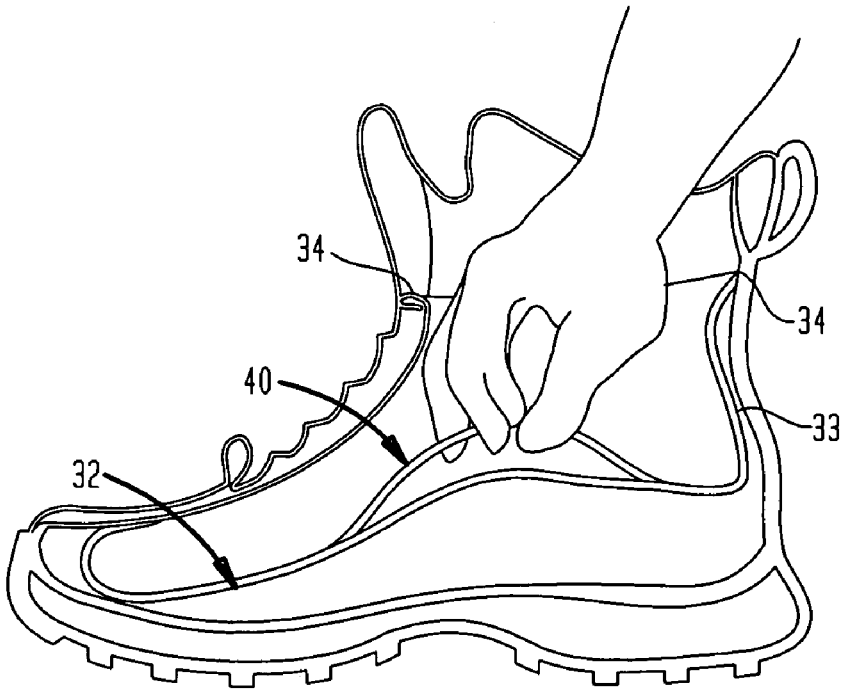
Figure 5C:
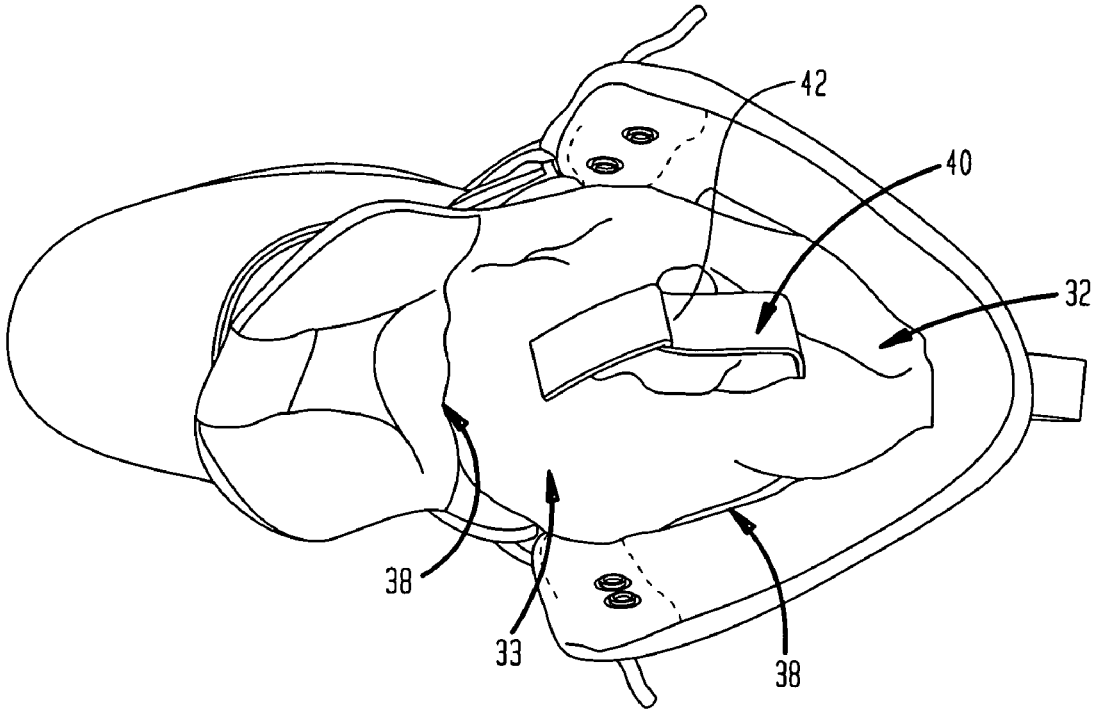

FIG. 5(*a*) is a top-down view showing the exposed bottom 36 of the liner 32 after the footbed 30 has been removed from the shoe 10. A disengagement device or structure 40 is preferably provided as part of the liner 32 to enable a user to easily pull the liner 32 out of the interior cavity 24. The disengagement device 40 provides a user with a way of grabbing a portion of the liner 32 to enable easy removal and insertion of the liner 32 from the interior cavity 24 and, in fully removable liners, from the shoe 10. Without the disengagement device 40, it can be very difficult for a user to pull the liner 32 out of the interior cavity, as there is normally no protrusion or other feature that can be grasped by a user's fingers. As will be described in more detail below, the disengagement device 40 can be of many different types, and can be positioned anywhere on the liner 32.

Multiple disengagement devices can be used on the same liner 32, and can be placed in multiple locations of the liner 32.

As seen in FIGS. 5(*b*)-(*c*), the disengagement device 40 preferably includes at least one pull-tab, handle or other form of handhold located on the inner surface of the liner 32 that the user can grasp with his or her fingers. FIG. 5(*c*) illustrates that the disengagement device 40, which is shown as a pull-tab, may be stitched or sewn at one or more points 42 to the bottom 36 or other portion of the liner 32.

Figure 6A:
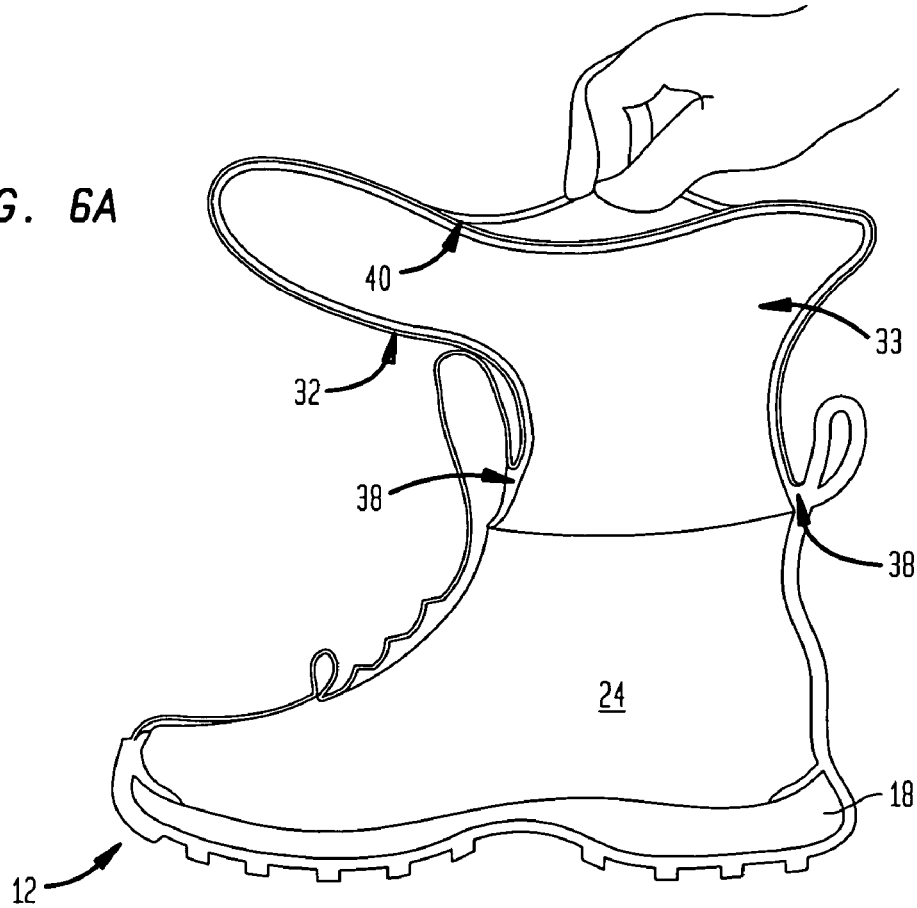
FIGS. 6(*a*)-(*c*) illustrate aspects of a liner in accordance with aspects of the present invention.
Figure 6B:
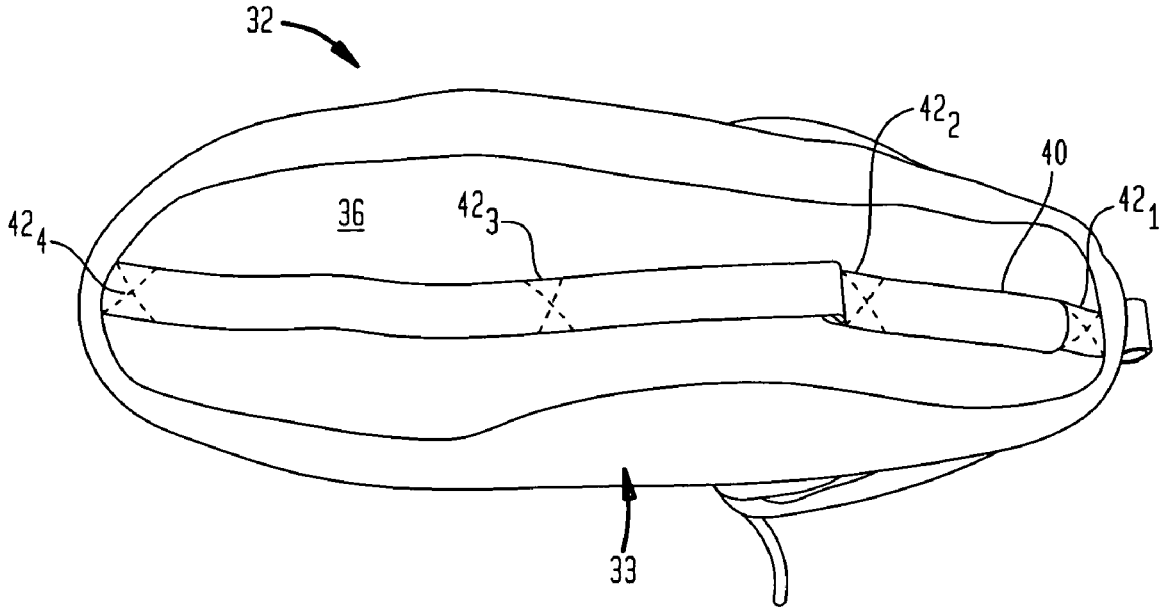
Figure 6C:
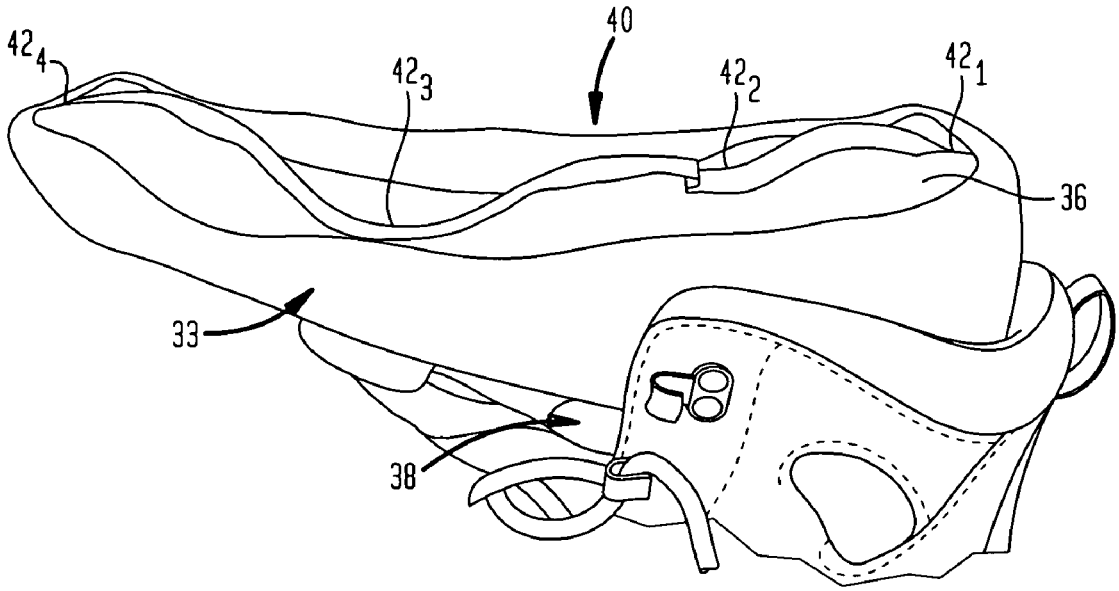

FIG. 6(*a*) illustrates a side cutaway view showing the liner 32 completely removed from the interior cavity 24. Preferably, the liner 32 is substantially fully inverted so that an inner surface(s) of the liner 32 that faces towards the foot during wear now faces outward for exposure to the air, which promotes effective drying. FIGS. 6(*b*)-(*c*) illustrate top and side views of the extracted liner 32, and show four connection points $\mathbf{42}_1$ . . . $\mathbf{42}_4$ along the length of the pull-tab. In this case, the four connection points $\mathbf{42}_1$ . . . $\mathbf{42}_4$ enable the user to grab at one or more of the three regions along the length of the liner 32 defined by the connection points, for instance a forward region near the toes, a middle region near the instep, and a rear region near the heel. However, it should be understood that a greater or lesser number of connection points 42 could be utilized. For example, as seen in an alternative example in FIG. 7, only three connection points $\mathbf{42}_1$ . . . $\mathbf{42}_3$ are employed. It may be desirable to configure the pull-tab or other disengagement device 40 so that the liner 32, and, optionally, the shoe 10 can be hung from the disengagement device 40. Furthermore, it may be desirable to position the disengagement device 40 at or near the front (toe) region and/or near the rear (heel) region of the bottom 36. The front and rear positions enable the user to fully invert the liner 32 to avoid creases or bunching of the material. This exposes the inner surface (s) of the liner material in the front and/or rear portions to the air, which, in turn, promotes more rapid drying.

Figure 7:
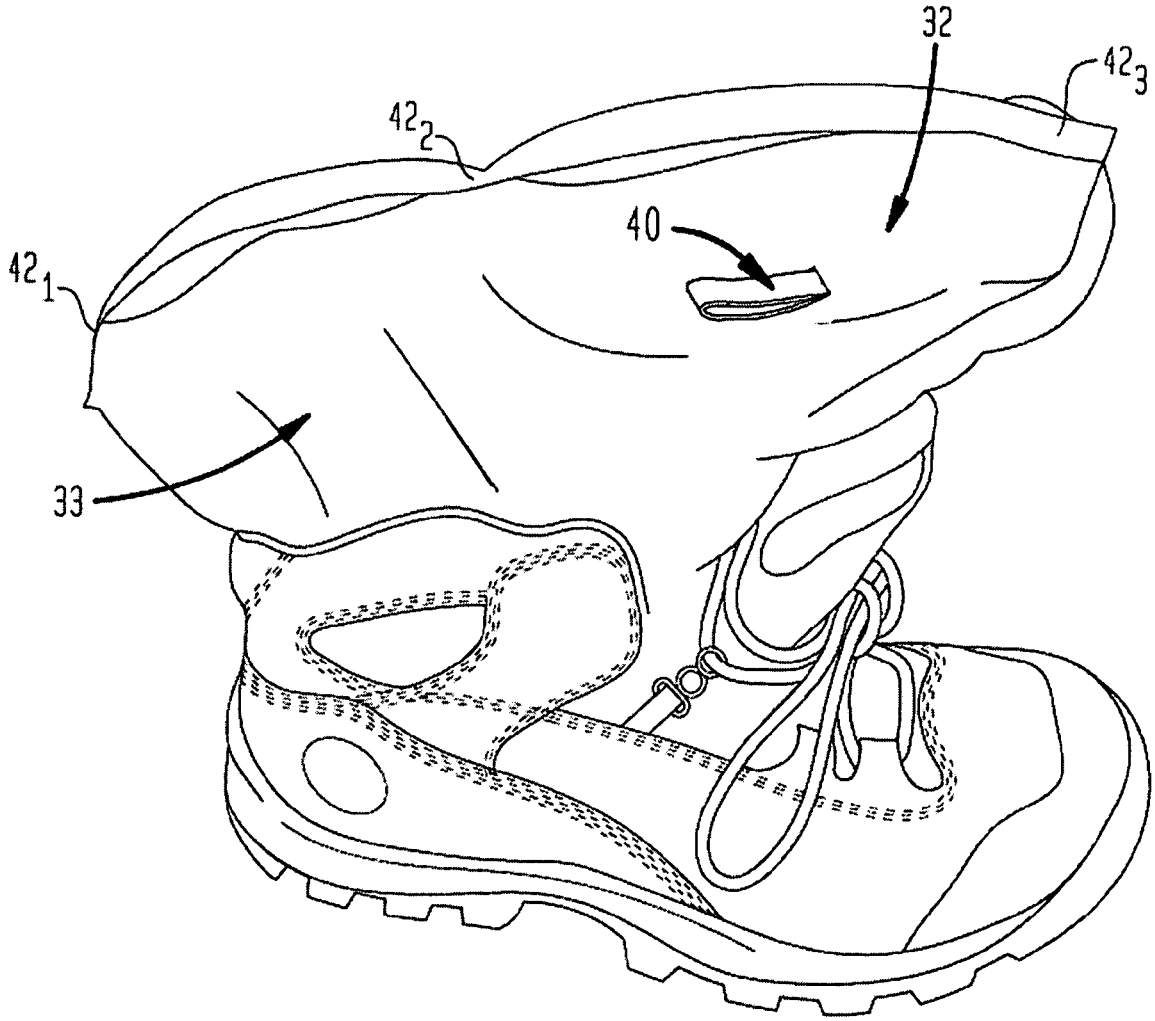
FIG. 7 illustrates an alternative liner in accordance with aspects of the present invention.

In FIGS. 6-7, the pull-tab is shown located along a central portion of the inner surface of the bottom 36 of the liner 32, running from the middle of the forefoot region to the middle of the heel region of the bottom 36. Of course, the pull-tab(s) may be placed anywhere along the liner 32 where it is convenient. By way of example only, the pull-tab may be placed closer to the medial or arch portion of the bottom 36 and run lengthwise from near the big toe towards the heel region, or the pull-tab may be placed closer to the lateral or outer portion of the bottom 36 and run lengthwise from near the pinkie toe towards the heel region. The pull-tab can also run width-wise from the medial side to the lateral side of the bottom 36, for example, along the forefoot region, the heel region, and/or the instep region. Of course, it should be understood that the pull-tab may have any number of different orientations instead of a lengthwise or width-wise placement, including any angling between lengthwise or width-wise positioning. For instance, the pull-tab may instead run diagonally from the medial portion of the forefoot to the lateral portion of the heel region, or may run diagonally from the lateral portion of the forefoot to the medial portion of the heel region. Regardless of the particular orientation of the pull-tab, placing the pull-tab at some location on the bottom 36 of the liner 32 allows for the pull-tab to be hidden by the shoe's footbed 30. This provides a comfortable placement for the pull-tab since the overlaying footbed 30 will keep the pull-tab from coming into contact with the wearer's foot. This, in turn, prevents the wearer from noticing the pull-tab or other disengagement device 40. Although not limited to being placed under the footbed, this location prevents the pull-tab from rubbing on the wearer's foot and creating discomfort. In alternate embodiments, the disengagement device 40 may be positioned anywhere along the sidewall 33 or even at the connection portion 34. The specific orientation along the sidewall 33 or at the connection portion 34 may be vertical, horizontal, or at any angle therebetween. Optionally, multiple disengagement devices 40 may be placed in different locations along the liner 32.

Figure 8:
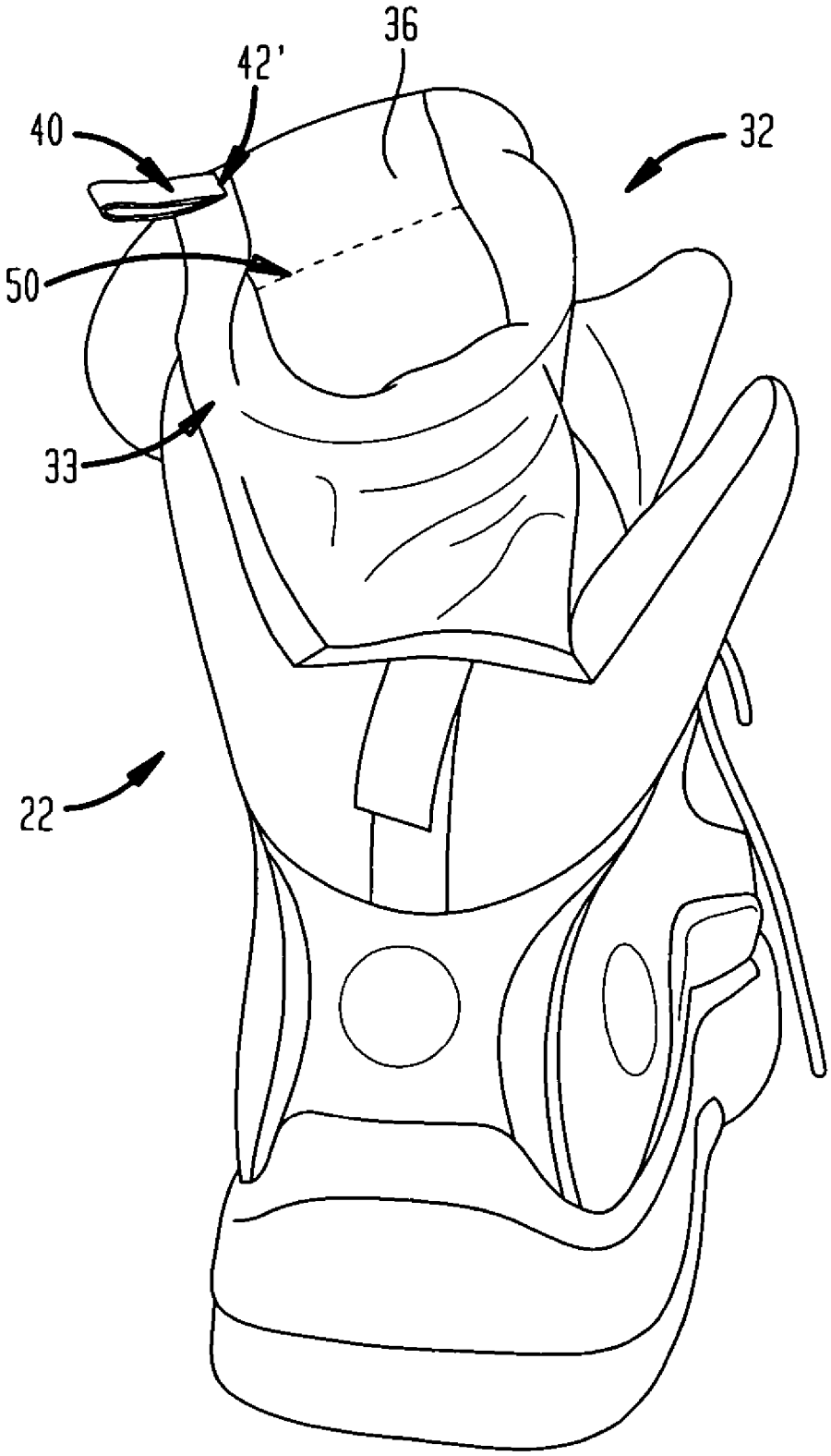
FIG. 8 illustrates another alternative liner in accordance with aspects of the present invention.
Figure 9A:
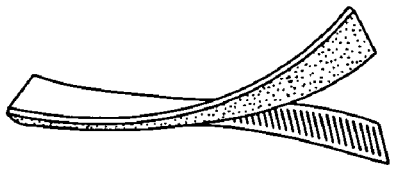
FIGS. 9(*a*)-(*e*) illustrate fasteners for use with liners of the present invention.
Figure 9B:
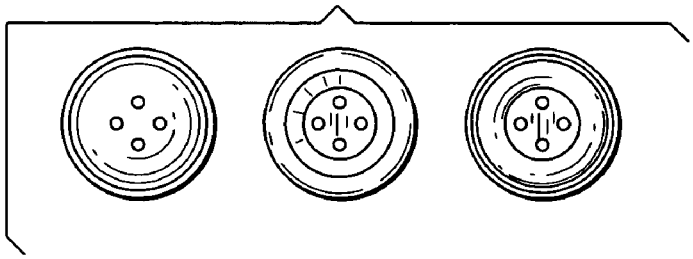
Figure 9C:
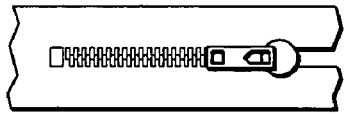
Figure 9D:
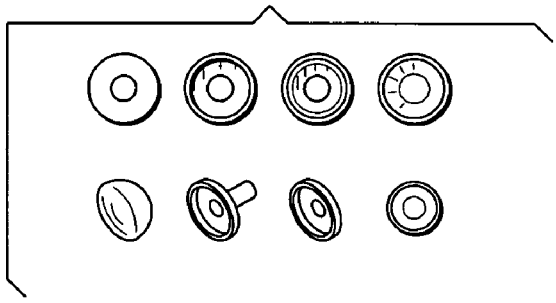
Figure 9E:
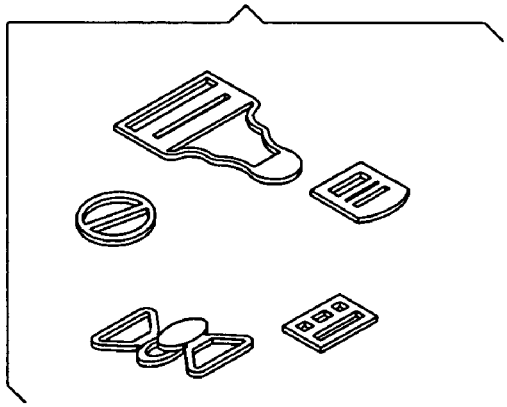

FIG. 8 illustrates an alternative disengagement device 40 in the form of a single loop. As shown, the single loop has a single connection point 42' that can be stitched along a seam between the bottom 36 and the sidewall 33 of the liner 32. The single loop may be grasped and pulled in the same manner as the pull-tab described above. The single loop is preferably located so that the footbed 30 covers it during wear. The footbed 30 may include a recess (not shown) having the same general shape and/or thickness of the single loop or the pull-tab. The recess would minimize the likelihood that a wearer would notice the single loop or the pull-tab when wearing the shoe 10.

The pull-tab and/or the single loop as shown in FIGS. 6-8 are preferably nylon straps or webbing, although other synthetic or natural materials can be used. The nylon straps desirably have a thickness on the order of 0.5 mm and a width on the order of 15 mm. It should be understood that the length of the nylon depends whether a single loop or a pull-tab is chosen, and on the number of connection points 42 desired.

In another alternative, the disengagement device 40 may comprise hook or loop fasteners on the top surface of the bottom 36 of the liner 32. Reciprocal loop or hook fasteners may be positioned on the bottom surface of the footbed 30. In this case, as the user grasps the footbed 30 for removal (see FIG. 4(*b*)), the liner 32 is pulled up and out along with the footbed 30.

Figure 10A:
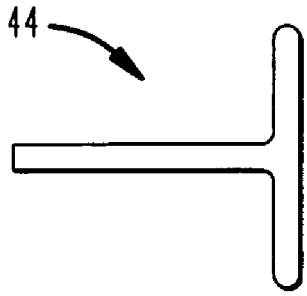
FIGS. 10(*a*)-(*c*) illustrate disengagement structures for use with liners of the present invention.
Figure 10B:
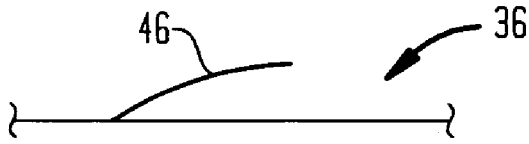
Figure 10C:
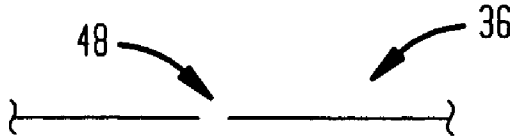

Numerous alternative disengagement devices 40 can be used in accordance with embodiments of the present invention. For example, as seen in FIG. 10(*a*), the disengagement device 40 may include a rigid or semi-rigid handle 44. If the handle 44 is employed, it may be desirable to include a recess in the footbed to accommodate the handle 44 as discussed above. As seen in the side view of FIG. 10(*b*), another type of disengagement device 40 may comprise an easy to grip flap of fabric 46 overlying at least a portion of the bottom 36. As seen in the side view of FIG. 10(*c*), the disengagement device 40 could simply include a graspable slit 48 in the bottom 36. The disengagement device 40 may also be selected and positioned to help in placing the liner 32 back into the shoe 10.

It can be seen that one or more disengagement devices 40 can be placed at various locations along the liner 32, preferably along the inner surface of the liner 32. The disengagement device(s) 40 is desirably positioned to enable easy and quick gripping. In addition, the placement and selection of the disengagement device 40 are preferably chosen to enable a user to pull the liner 32 out from the interior cavity 24 in a single motion. More preferably, the selection and placement of the disengagement device 40 permits the user to expose the greatest amount of surface area of the inner surface of the liner 32 to the air, which will facilitate drying. For instance, multiple disengagement devices 40 may be placed at or near the connection portion 34, along the sidewall 33, and/or on the bottom 36 to enable a person with arthritis or other disability to pull the liner 32 out of the interior cavity 24 a little at a time. Alternatively, the disengagement device(s) 40 may be placed at or near the toe, arch and/or heel regions of the bottom 36 to allow different length fingers to grasp the handhold or other grab point. Furthermore, different types of disengagement devices 40 such as those described above can be used together in a single liner 32. Using different types of disengagement devices 40 may be particularly beneficial to a wide variety of users who may find it easier to grasp or pull one type of disengagement device 40 instead of another type.

As discussed above, the liner 32 may comprise one or more sections and/or layers of material that are connected together. Depending upon the kind of shoe 10 in which the liner 32 may be used, it may be desirable to form the bottom 36 of the liner 32 from a rigid or semi-rigid structure. The structure can be any material which provides more rigidity than the material used in the sidewall 33, and which would be suitable for holding the shape and geometry of the bottom 36 to avoid wrinkling or creases. Examples of materials suitable for a rigid or semi-rigid structure include material stiffeners such as cotton drill, thin lasting board constructions such as cardboard or similar materials, injected plastics or plastic films. The thickness of the rigid or semi-rigid structure can vary depending upon the material(s) and/or environmental factors. By way of example only, injected plastics or plastic films may be less than 0.75 mm thick. One or more layers of thin cardboard may each be on the order of 0.5-5 mm. The cotton drill might be at least 1 mm thick. Alternatively, the bottom 36 may simply be made of a material stiffer than the material used for the sidewall 33. Optionally, the bottom 36 may include a roughened material surface, tacky material, etc to create friction and to minimize the movement of the liner 32 when the shoe 10 is worn.

One benefit to a a rigid or semi-rigid structure is the rigidity it provides to the bottom 36, which helps to prevent bunching of the liner 32 near the bottom of the interior cavity 24, particularly in situations where the footbed 30 is not used and therefore cannot smooth out wrinkles in the liner 32. However, depending upon the size and shape of the collar 22 of the upper 14, it may be difficult to remove a rigid bottom 36. Thus, as seen by the dashed line 50 in FIG. 8, it is possible to provide a "living hinge" or score line across the width (and/or across the length) of the bottom 36. The living hinge permits the user to fold or partly collapse the bottom 36 as part of the removal and reinsertion processes.

The liner 32 can be quickly and easily reinserted into the interior cavity 24 by pressing on the bottom 36 of the inner surface of the liner 32 with a hand. Optionally, the disengagement device 40 can also be used to help reinsert the liner 32 by providing a handhold or gripping section for the user. Once the liner 32 is inserted into the interior cavity 24, the user can use his or her hand to smooth out the bottom 36 if necessary. Alternatively, bunching can be smoothed out when the footbed 30 is inserted into the interior cavity 24. Depending upon the connector 38 used, it may be necessary to attach the replaceable or detachable liner 32 to the collar 22 prior to insertion of the liner 32, or it may be possible to perform the attachment after the liner 32 has been inserted.

It can be seen from the embodiments described above that removable and/or replaceable liners in accordance with the present invention can be formed in a wide variety of configurations. Liners that are permanently connected to the collar of the upper permit the wearer to remove the liners from the interior cavity in the shoe. This permits rapid drying of the liner. Semi-permanently attached liners can be detached for cleaning/drying or for replacement with a different liner depending on the needs of the wearer. Many different kinds of disengagement devices are possible, and permit the wearer to rapidly and easily remove the liner from the interior cavity.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants.

The invention claimed is:

1. An article of footwear comprising:

an outsole;

an upper attached to the outsole, the upper having an interior surface including a collar and a body connected to the collar, the body defining a cavity for receiving a foot and the collar providing an opening to the cavity;

a liner configured to at least partly encompass the foot within the cavity, the liner including a connector to securely connect the liner about the collar and a disengagement unit to aid a user in removing the liner from within the cavity; and a removable footbed having a top surface adapted to contact the foot and a bottom surface for overlying an inner surface of the liner when the removable footbed is disposed within the cavity;

wherein the bottom surface of the footbed at least partly covers the disengagement unit during wear, and upon removal of the footbed the disengagement unit is exposed for gripping by the user.

2. The article of footwear of claim 1, wherein the disengagement unit comprises a pull-tab.

3. The article of footwear of claim 2, wherein the pull-tab is affixed to a bottom portion of the liner.

4. The article of footwear of claim 3, wherein the pull-tab comprises nylon and includes a plurality of connection points to connect to the bottom portion of the liner.

5. The article of footwear of claim 1, wherein the disengagement unit comprises a loop of material affixed to a bottom portion of the liner.

6. The article of footwear of claim 1, wherein the disengagement unit comprises hook and loop fasteners.

7. The article of footwear of claim 1, wherein the disengagement unit comprises a handle.

8. The article of footwear of claim 1, wherein the disengagement unit comprises fabric flap.

9. The article of footwear of claim 1, wherein the disengagement unit comprises a slit in a bottom portion of the liner.

10. The article of footwear of claim 1, wherein a bottom portion of the liner comprises a rigid or semi-rigid structure.

11. The article of footwear of claim 10, wherein the rigid or semi-rigid structure is cotton drill, cardboard, an injected plastic or a plastic film.

12. An article of footwear, comprising:

an outsole;

an upper attached to the outsole, the upper having an interior surface including a collar and a body connected to the collar, the body defining a cavity for receiving a foot and the collar providing an opening to the cavity; and a liner configured to at least partly encompass the foot within the cavity, the liner including a disengagement unit to aid a user in removing the liner from within the cavity, wherein a bottom portion of the liner comprises a rigid or semi-rigid structure, the bottom portion of the liner has a living hinge, and the bottom portion of the liner is foldable along the living hinge to remove the liner from the cavity of the upper.

13. The article of footwear of claim 1, wherein the connector permanently secures the liner to the collar.

14. The article of footwear of claim 1, wherein the connector semi-permanently secures the liner to the collar.

15. The article of footwear of claim 1, wherein the upper includes a tongue and the connector securely connects the liner to the tongue.

16. An article of footwear comprising:

an outsole;

an upper attached to the outsole, the upper having an interior surface including a collar and a body connected to the collar, the body defining a cavity for receiving a foot and the collar providing an opening to the cavity; and a liner configured to at least partly encompass the foot within the cavity, the liner including a connector to removably connect the liner about the collar so that a user can completely remove the liner from the article of footwear and a disengagement unit to aid a user in removing the liner from within the cavity, the disengagement unit including a strip of material secured at multiple locations to an inner surface of a bottom portion of the liner;

whereby the multiple locations include a first location at a toe region of the bottom portion and a second location at a heel region of the bottom portion.

17. The article of footwear of claim 16, wherein the connector comprises a hook and loop fastener.

18. The article of footwear of claim 16, wherein the connector comprises a zipper.

19. The article of footwear of claim 16, wherein the connector comprises at least one snap fastener.

20. The article of footwear of claim 16, wherein the connector comprises at least one hook fastener.

21. The article of footwear of claim 16, wherein the connector comprises at least one button.

22. The article of footwear of claim 16, wherein the liner is interchangeable with a plurality of different liners.

23. The article of footwear of claim 22, wherein at least one of the plurality of different liners comprises a hydrophobic liner, a hydrophilic liner, a high permeability liner, a comfort liner or a fleece liner.

24. A kit of footwear liners for use with an article of footwear, the kit comprising:

interchangeable liners, configured to at least partly encompass a foot within a cavity of the article of footwear, each of the interchangeable liners including a connector to removably connect the liner about a collar of the article of footwear so that a user can completely detach the liner from the article of footwear and a disengagement unit to aid a user in removing the liner from within the cavity, the disengagement unit including a strip of material secured at multiple locations to an inner surface of a bottom portion of the liner;

whereby the multiple locations include a first location at a toe region of the bottom portion and a second location at a heel region of the bottom portion;

wherein the interchangeable liners can be selected depending on climate conditions or a type of activity.

25. The kit of footwear liners of claim 24, wherein the interchangeable liners are selected from the group consisting of a hydrophobic liner, a hydrophilic liner, a high permeability liner, a comfort liner and a fleece liner.

26. An article of footwear comprising:

an outsole;

an upper attached to the outsole, the upper having an interior surface including a collar and a body connected to the collar, the body defining a cavity for receiving a foot and the collar providing an opening to the cavity; and a liner configured to at least partly encompass the foot within the cavity, the liner including a connector to securely connect the liner to the collar and a disengagement unit to aid a user in removing the liner from within the cavity, the disengagement unit including a strip of material secured at multiple locations to an inner surface of a bottom portion of the liner;

whereby the multiple locations include a first location at a toe region of the bottom portion and a second location at a heel region of the bottom portion.

27. The article of footwear of claim 26, further comprising a removable footbed having a top surface adapted to contact the foot and a bottom for overlying the bottom portion of the liner when the removable footbed is disposed within the cavity, the bottom of the removable footbed including a recess adapted to receive the disengagement unit so that the disengagement unit is disposed within the recess during wear and is not felt by the user during wear.

28. The article of footwear of claim 26, wherein the strip of material of the disengagement unit is secured at multiple locations along a central line to the inner surface of the bottom portion of the liner.

29. The article of footwear of claim 26, wherein the liner at least partly contacts the body of the interior surface.

* * * * *